US005910000A

United States Patent [19]

Schade et al.

[11] Patent Number: 5,910,000

[45] Date of Patent: Jun. 8, 1999

[54] EXHAUST GAS TURBOCHARGER TURBINE FOR AN INTERNAL COMBUSTION ENGINE

[75] Inventors: Marco Schade, Nordhausen; Erwin Schmidt, Baltmannsweiler; Siegfried Sumser, Stuttgart, all of Germany

[73] Assignee: Daimler-Benz AG, Stuttgart, Germany

[21] Appl. No.: 08/962,900

[22] Filed: Nov. 3, 1997

[30] Foreign Application Priority Data

Nov. 4, 1996 [DD] German Dem. Rep. ..... 196 45 388

[51] Int. Cl.[6] ..... F01D 1/08

[52] U.S. Cl. ..... 415/158

[58] Field of Search ..... 415/157, 158, 415/167; 417/407

[56] References Cited

U.S. PATENT DOCUMENTS 5,452,986 9/1995 Osborne et al. .

FOREIGN PATENT DOCUMENTS 42 32 400 8/1993 Germany .
95/19499 7/1995 WIPO .

*Primary Examiner*—Christopher Verdier
*Attorney, Agent, or Firm*—Klaus J. Bach

[57] ABSTRACT

In an exhaust gas turbocharger turbine for an internal combustion engine with a turbine housing having an annular flow path, a control sleeve axially movably supported in an annular space formed in the turbine housing adjacent the annular flow path and having at its front end a flow guide structure with vanes for guiding the exhaust gas flow when the flow guide structure is disposed in the annular flow path, a ring is disposed at the front end of the control sleeve in front of the flow guide structure such that the annular space is covered and sealed when the control sleeve is fully retracted into the annular space whereby flow losses are substantially reduced.

5 Claims, 2 Drawing Sheets

EXHAUST GAS TURBOCHARGER TURBINE FOR AN INTERNAL COMBUSTION ENGINE

BACKGROUND OF THE INVENTION

The invention relates to an exhaust gas turbocharger turbine for an internal combustion engine with an axially slidable control sleeve, which include guide vanes and is supported in an annular gap between the turbine housing and an annular guide structure and with an annular gas flow passage disposed in the turbine housing and leading to the turbine wheel.

DE 47 32 400 Cl discloses an exhaust gas turbocharger turbine for an internal combustion engine with an adjustable flow guide mechanism. It includes an annular control sleeve, which is axially movable for blocking the inlet flow cross-section between a guide channel and a turbine wheel. In this way, a throttling cross-section forming a brake gap for a motor brake can be provided.

However, because of its design, turbulence is generated within the housing of this exhaust gas turbocharger turbine which leads to a relatively low efficiency of the whole exhaust gas turbocharger turbine. In addition, the arrangement described in this reference will have gap losses caused by the escape of exhaust gases, which further decrease the turbine efficiency.

U.S. Pat. No. 5,452,986 discloses a diffuser structure for a turbo machine having a housing with a control arrangement including an axially movable control ring. The control ring includes flow guides vanes and is supported in an annular space formed in the housing. The flow guide vanes extend through openings in a guide ring into the flow path of the gas and are axially movable with the control ring whereby they are rotated for varying the stagger angle of the vanes depending on how far they are projecting into the flow passage.

This arrangement, however, has the disadvantage that, when the guide vanes extend into the flow passage, there is a gap between the control ring and the guide ring at the openings of the guide ring. As a result, insufficient sealing is achieved when the guide vanes are fully retracted from the annular flow passage. As a result, turbulence can occur in the area of the openings.

It is the object of the present invention to provide an exhaust gas turbocharger turbine for an internal combustion engine with improved flow conditions within the turbine housing and relatively low gap losses.

SUMMARY OF THE INVENTION

In an exhaust gas turbocharger turbine for an internal combustion engine with a turbine housing having an annular flow path, a control sleeve axially movably supported in an annular space formed in the turbine housing adjacent the annular flow path and having at its front end a flow guide structure with vanes for guiding the exhaust gas flow when the flow guide structure is disposed in the annular flow path, a ring is disposed at the front end of the control sleeve in front of the flow guide structure such that the annular space is covered and sealed when the control sleeve is fully retracted into the annular space.

Since the ring at the front end of the axially movable vane sleeve covers and closes the annular gap between the turbine housing and the inner vane sleeve support structure, the gap losses and turbulence in this area are substantially reduced. This results in an increased efficiency of the exhaust gas turbocharger and, consequently, of the whole internal combustion engine which finally leads to reduced fuel consumption.

Preferred embodiments of the invention will be described below on the basis of the accompanying drawings.

DESCRIPTION OF THE PREFERRED EMBODIMENTS

Figure 1:
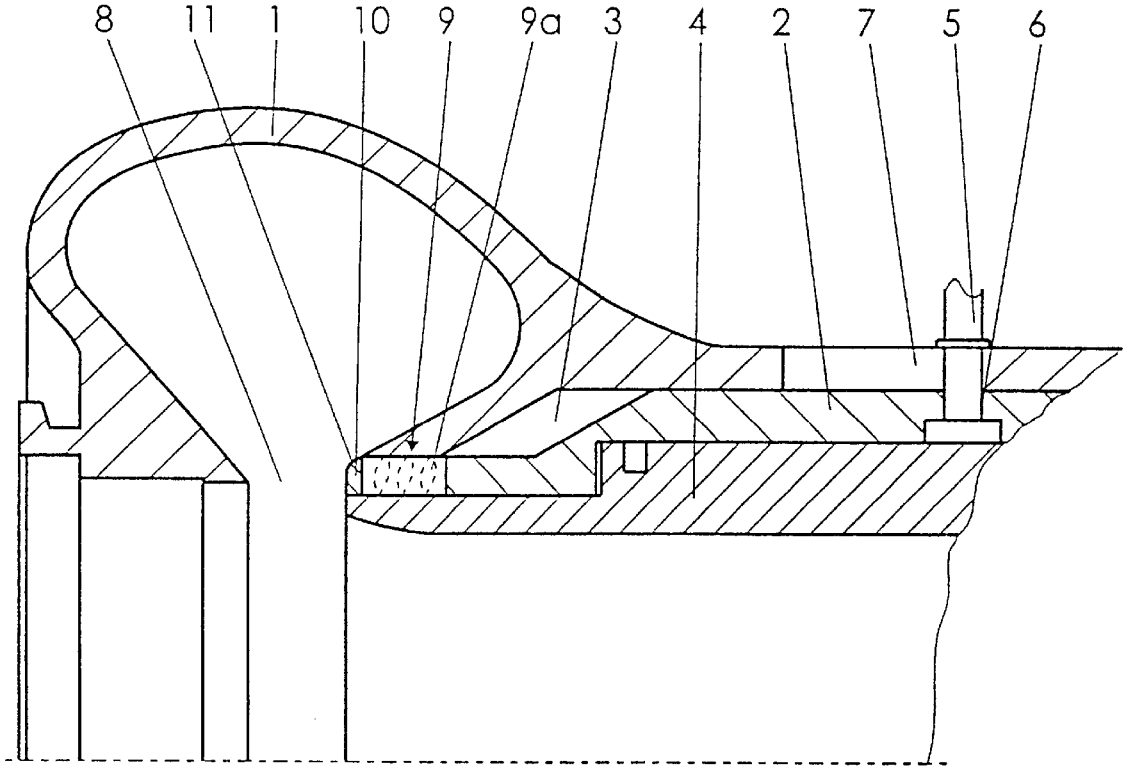
FIG. 1 is a cross-sectional view of a housing portion of an exhaust gas turbocharger turbine with an axially slidable sleeve shown in a retracted position and having a ring at its front end.

FIG. 1 is a cross-sectional view of a portion of a turbine housing 1 of an exhaust gas turbocharger, which is part of an internal combustion engine not shown in the drawings.

Within the turbine housing 1, a sleeve-like axial slide member 2 is disposed in an annular space 3, which is formed between the turbine housing 1 and an inner sleeve guide structure 4. The axial slide member 2 can be moved axially within the annular space 3 by a control arrangement including a control pin 5 which extends into a bore 6 in the axial slide member 2 and is guided in a guide slot 7.

The turbine housing includes an annular flow path 8 for admitting gas to a turbine wheel which is not shown. The amount of gas admitted to the turbine wheel through the flow path 8 can be controlled by axial movement of the axial slide member 2, by means of the control pin 5, into the flow path 8. The axial slide member 2 is provided with a flow guide structure 9, which includes guide vanes 9*a*.

FIG. 1 shows the axial slide member 2 fully retracted into the annular space 3 in which position exhaust gas can flow through the flow path 8 in an unobstructed manner.

However, since the exhaust gases flowing through the flow path 8 are very hot, the temperature of the flow guide structure rises to such a degree that it may be deformed resulting in leakage flows. In order to prevent the escape of gases through the annular space 3 as a result of seal problems, the flow guide structure 9 carries a ring 10 at its axial end adjacent the flow path 8. The ring 10 completely covers and closes the annular space 3 when the flow guide structure is fully retracted into the annular space 3 as shown in FIG. 1. In this way, the gap losses of the exhaust gas turbocharger are substantially reduced.

Figure 2:
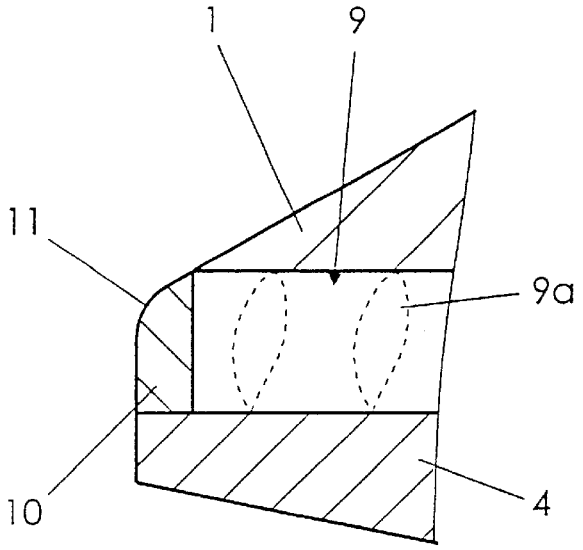
FIG. 2 is an enlarged representation of the ring as shown in FIG. 1.
Figure 3:
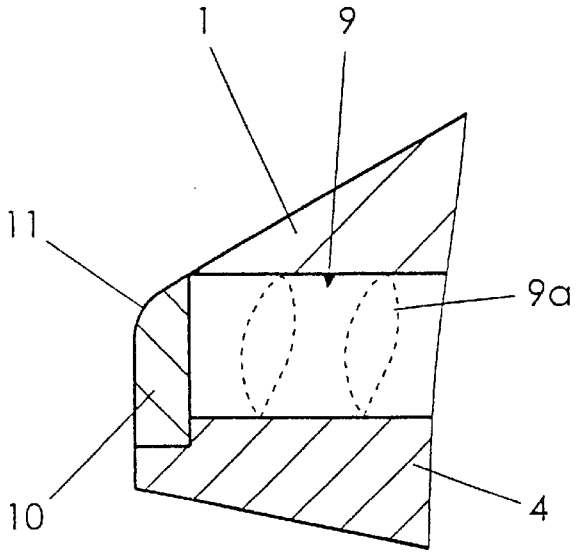
FIG. 3 is an enlarged representation of a second embodiment of the ring.
Figure 4:
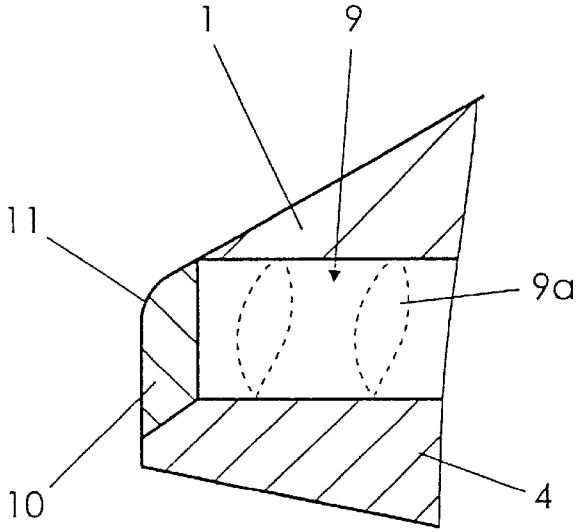
FIG. 4 is an enlarged representation of a third embodiment of the ring.

FIG. 2, FIG. 3 and FIG. 4 show various embodiments of the ring 10. In each case, it is provided with a rounded edge area 11 at its outer circumference whereby the flow conditions within the turbine housing 1 are improved. The flow conditions are optimized by a shape of the edge area which continues the shape of the wall of the turbine housing 1 without interruption.

As shown in FIG. 3, the inner sleeve guide structure 4 is provided with a recess in which the ring 10 is received when the flow guide structure 9 is fully retracted. Then the face of the ring 10 is in planar alignment with the face of the sleeve guide structure 4.

In the arrangement as shown in FIG. 4, the ring 10 and the front end of the inner sleeve guide structure 4 have cooperating conical portions by which they are engaged with one another when the flow guide structure is fully retracted. This arrangement also provides for a good seal between the ring 10 and the inner sleeve guide structure 4. The various embodiments of the ring 10 improves the flow conditions within the turbine housing 1 and substantially reduce the gap losses of the exhaust gas turbocharger.

What is claimed is:

1. In an exhaust gas turbocharger turbine for an internal combustion engine including a turbine housing with an annular flow path, a control sleeve with a front end axially movably supported in an annular space formed in said housing adjacent said annular flow path, and means for axially moving said control sleeve out of and into said annular flow path for controlling exhaust gas flow through said annular flow path onto a turbine wheel, said control sleeve having, in the area which is movable into said annular flow path, a flow guide structure with vanes for guiding the exhaust gas flow through said annular flow path, the improvement comprising: a ring disposed at the front end of said control sleeve in front of said flow guide structure, said ring covering and sealing said annular space when said control sleeve is fully retracted into said annular space and said annular flow path is fully open.

2. An exhaust gas turbocharger turbine according to claim 1, wherein said annular space is formed between said housing and an internal control sleeve guide structure, said control sleeve guide structure having a conical end face adjacent said flow path and said ring at the front end of said control sleeve having a corresponding conical section for engagement with the conical end face of said control sleeve guide structure when said control sleeve is fully retracted into said annular space.

3. An exhaust gas turbocharger according to claim 1, wherein said annular space is formed between said housing and an internal control sleeve guide structure, said control sleeve guide structure having at its front end adjacent said flow path a recess formed therein and said ring is sized and shaped so as to fit into said recess when said control sleeve is fully retracted into said annular space.

4. An exhaust gas turbocharger according to claim 1, wherein said ring is rounded at its outer area adjacent said annular flow space.

5. An exhaust gas turbocharger according to claim 4, wherein said ring is rounded such that there is a smooth transition between the wall of the turbine housing and the ring surface when the control sleeve is fully retracted into said annular space.

* * * * *